United States Patent [19]

Mobus et al.

[11] 4,176,265

[45] Nov. 27, 1979

[54] ILLUMINATED ELECTRIC SWITCHES

[75] Inventors: Dietmar Mobus, Trebur; Gunter Ehrenberger, Russelsheim; Wolfgang Jobst, Nauheim, all of Fed. Rep. of Germany

[73] Assignee: General Motors Corporation, Detroit, Mich.

[21] Appl. No.: 864,635

[22] Filed: Dec. 27, 1977

[30] Foreign Application Priority Data

Jan. 25, 1977 [DE] Fed. Rep. of Germany ..... 2702839

[51] Int. Cl.[2] ..... H01H 9/18

[52] U.S. Cl. ..... 200/316; 362/222

[58] Field of Search ..... 200/313, 310, 316, 317; 362/23, 29, 287, 290, 291, 322, 325

[56] References Cited

U.S. PATENT DOCUMENTS

| | | | |
|---|---|---|---|
| 2,144,138 | 1/1939 | Batcheller | 362/322 |
| 2,798,924 | 7/1957 | Kimball | 200/316 |
| 2,911,458 | 11/1959 | McKee | 362/322 |
| 3,320,393 | 5/1967 | Sohns | 200/316 |

*Primary Examiner*—Herbert F. Ross

*Attorney, Agent, or Firm*—E. J. Biskup

[57] ABSTRACT

In an illuminated rotary electric switch, for use in a motor vehicle to indicate the location of the switch, its condition of operation, and, if desired, its function, a manually rotatable switch member is provided with a central opening arranged so that light can be projected longitudinally therethrough from a single light source so as to indicate the location of the switch (and its function, if desired) and with a further opening which can be brought into and out of registration with an aperture in a fixed portion of the switch through which light from said source can be projected laterally, so as thereby to uncover or mask said aperture and thus indicate the condition of operation of the switch.

3 Claims, 7 Drawing Figures

ILLUMINATED ELECTRIC SWITCHES

This invention relates to illuminated electric switches and more particularly to illuminated rotary electric switches suitable for use on motor vehicles to indicate the location of the switch and its condition of operation.

The present invention was devised with a view to providing an illuminated rotary switch in which, with the use of a single light source, it would be possible to indicate not only the location of the switch and, if desired, its function, but also to indicate the state of operation of the switch; for example, to indicate whether the switch is "ON" or "OFF" or whether the switch is in one of a number of different "ON" positions.

In an illuminated rotary electric switch according to the present invention a manually rotatable switch member is provided with a central opening arranged so that light from a single light source can be projected therethrough to indicate the location of the switch (and, if its function), and with a further opening which can be brought into and out of registration with an aperture in a fixed portion of the switch through which light from said source can be projected so as thereby to uncover or mask said aperture and thus indicate the condition of operation of the switch.

The scope of the invention is defined by the appended claims; and the invention and the method by which it is to be performed are hereinafter particularly described with reference to the accompanying drawings in which FIG. 1 is a longitudinal section through one embodiment of an illuminated rotary electric switch according to the invention;

Figure 3:
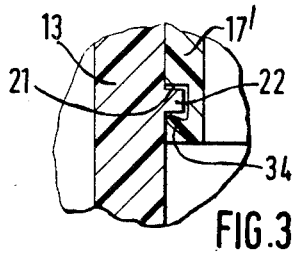
FIG. 3 is an enlarged detail of the portion of the switch indicated within the circle "A" in FIG. 1.

FIGS. 1 to 4 show an illuminated rotary electric switch having a stationary carrier 10 and a bulb holder assembly 11, with a terminal connector 12 thereon, which fits within a central aperture in a base plate 16 of the carrier 10. The carrier 10 has an inner hollow cylindrical wall 13 and a cylindrical outer wall 14 concentric with and extending around said inner wall 13, said inner and outer walls 13, 14 being moulded integral with the base plate 16.

A rotary switch knob 17 has a cylindrical portion 17' rotatably mounted on the inner cylindrical wall 13, and a radially extending flange 17'' integral therewith which extends between said inner and outer walls 13, 14 and rotatably engages said outer wall 14. The switch knob 17 has at its upper end a light-transmitting opening 18 concentric with a window 19 of transparent material which forms the closure to the upper end of the cylindrical wall 13. The window 19 may be provided with a symbol thereon indicating the function of the switch, and the rotary switch knob 17 has at its upper end an internal annular abutment face 20 between which and an annular shoulder at the upper end of the wall 13 the window 19 is clamped when the rotary switch knob 17 is fitted on the wall 13.

As can be seen in particular from FIG. 3, the rotary switch knob 17 is secured axially but rotatably relative to the stationary carrier 10 by an internal annular groove 21 formed in the cylindrical portion 17' of the knob and an external collar 22 formed integral with the inner cylindrical wall 13 of the carrier 10.

Figure 1:
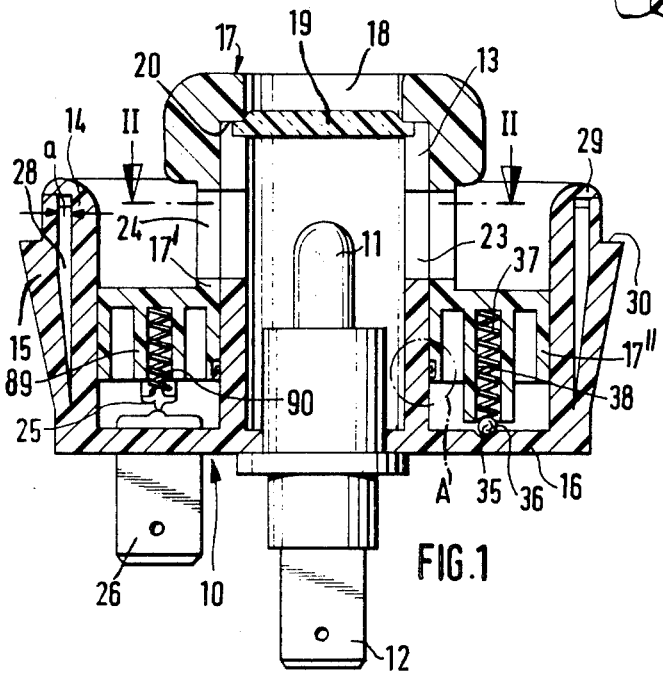
Figure 2:
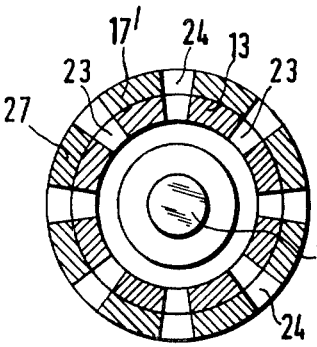
FIG. 2 is a section on the line 2—2 of FIG. 1.

As shown in FIGS. 1 and 2, the inner wall 13 of the carrier 10 has extending therethrough a plurality of circumferentially equi-spaced and longitudinally extending slots 23. The cylindrical portion 17' of the switch knob 17 which extends around the slots 23 is formed as a light-directing shutter and for this purpose is formed with slots 24 extending therethrough which in spacing, size and length correspond to the slots 23 in the knob 17. In the switch position indicated, the slots 23, 24 are in register with each other so that light from the light source 11 can pass radially outwardly and become visible as a ring of light surrounding the central illuminated opening and window 18, 19 at the end of the knob 17.

As shown in FIG. 1, the flange portion 17'' of the switch knob 17 is formed with an integral tubular housing 89 for a helical spring 90 engaging a movable contact 25 which, in the "ON" position of the switch shown in FIG. 1, is pressed into engagement with a fixed contact 26 fixed in the base plate 16.

Rotation of the switch knob 17 disengages the contacts 25, 26 and in this "OFF" position of the switch (not shown) the slots 24 are brought out of register with the slots 23 which are then covered by opaque portions 27 (FIG. 2) of the cylindrical portion 17' of the switch knob 17. In this "OFF" position of the switch no light can pass radially outwardly from the cylindrical inner wall 13 so that the ring of light which was visible in the "ON" position of the switch disappears. However, the light from the light source 11 can still pass through the window 19 and opening 18 and thus renders the position of the switch visible and also illuminates any indicator symbol which may be on the window 19.

In order to retain the switch knob 17 in either its "ON" or "OFF" positions the flange 17'' is formed with a tubular housing 38 for a helical spring 37 which engages a ball 35 which, upon rotation of the switch 17 from its "ON" to its "OFF" position, or vice versa, engages in corresponding recesses 36 (of which only one is shown) impressed in the base plate 16 of the carrier 10.

Figure 4:
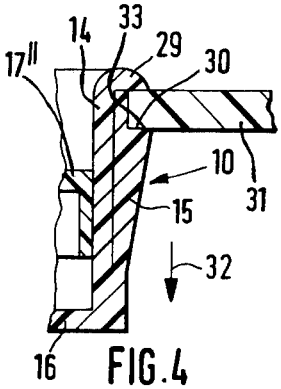
FIG. 4 is a detail section of the switch of FIG. 1, showing its position when installed.

As shown in FIGS. 1 and 4, the carrier 10 has integral therewith a sleeve 15 extending coaxially outwardly from the base 16 towards and around the upper portion of the wall 14 to form a substantially conical annular gap 28 between the sleeve 15 and the wall 14. The upper end of the wall 14 is outwardly flared to form a smoothly curved rim 29 which overlies the upper end of the sleeve 15 which, adjacent its upper end is formed with an external annular collar with an upwardly facing abutment face 30. As shown in FIG. 1, the sleeve 15 is normally spaced from the wall 14 by a distance a but, when the rotary switch assembly is fitted into a corresponding aperture 33 in an instrument panel 31 of a motor vehicle for example, (in the direction indicated by the arrow 32 in FIG. 4), the sleeve 15 is resiliently deflected so as to close the gap a, the upper end of the sleeve 15 forming a snap-fit in the opening with opposite faces of the edge of the panel opening 33 gripped between the face 30 of the sleeve 15 and the lower face of the rim 29 of outer wall 14.

Figure 5:
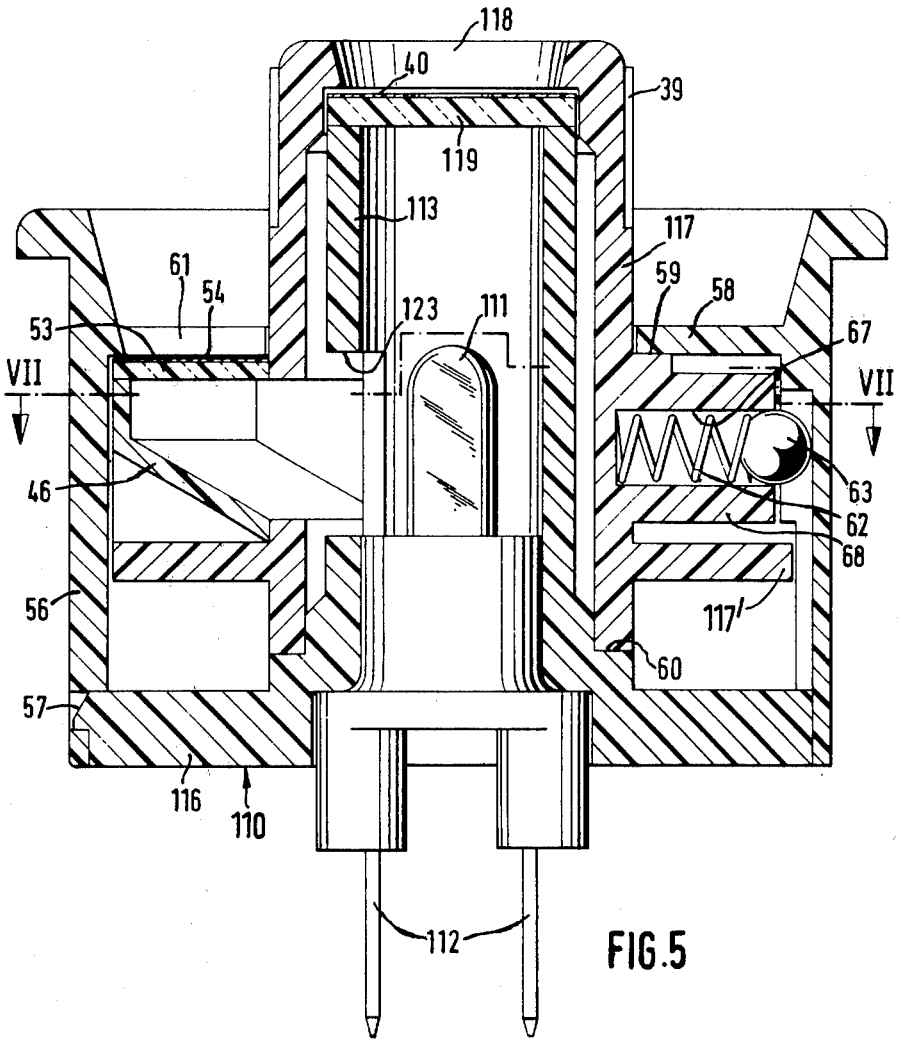
FIG. 5 is a longitudinal section of a second embodiment of a switch according to the invention, on the line V—V of FIG. 7.
Figure 7:
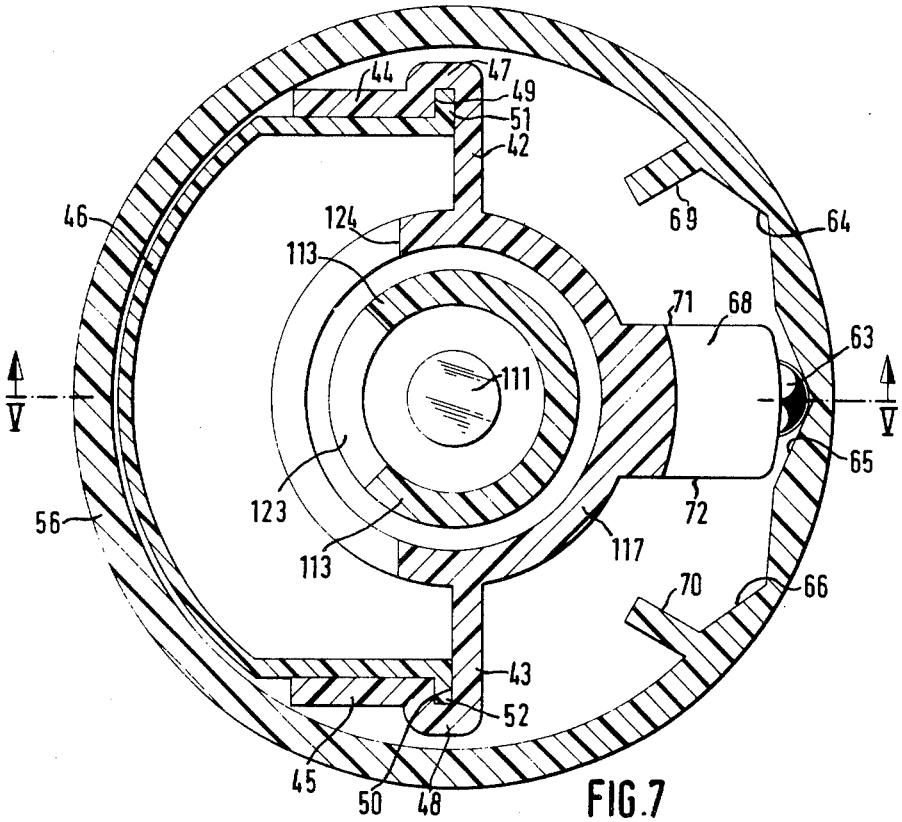
FIG. 7 is a section on the line VII—VII of FIG. 5.
Figure 6:
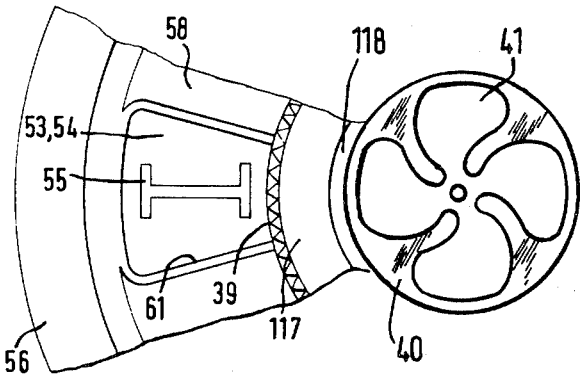
FIG. 6 is a plan of part of the switch of FIG. 5.

FIGS. 5 to 7 show another embodiment of the invention in which the illuminated rotary electric switch is formed with a stationary carrier 110 and a light source comprising a bulb and holder assembly 111, with terminals 112 extending therefrom, which fits within a central aperture in a base plate 116. The carrier 110 includes an outer cylindrical wall 56 which has a snap fit connection with the outer peripheral portion of the base plate 116, as indicated at 57. The base plate 116 has formed integral therewith a hollow cylindrical inner wall 113 the upper end of which is closed by a transparent window 119 upon which is imprinted a mask 40 of appropriate pattern to provide a symbol 41 indicating the function of the switch. In the example shown, indicated in FIG. 6, the symbol 41 is that for the blower or fan of a motor vehicle ventilation system.

Rotatably mounted on the carrier on a shoulder 60 adjacent the lower end of the inner wall 113, and extending therearound, is a switch knob 117 the upper end of which is knurled, as indicated at 39, to provide a grip for manual operation of the switch. The upper end of the knob 117 is formed with an opening 118 in register with the window 119 and the symbol 41 thereon, so that, when the light source 111 is energised the symbol 41 will be illuminated from behind and will be visible in silhouette.

As shown in FIGS. 5 and 7, inner wall 113 has a segmental opening 123 therein through which light is projected laterally from the light source 111, the opening subtending an angle of approximately 90° at the axis of the switch. The rotary switch knob 117 has an opening 124 (FIG. 7) which extends over approximately twice the angle of the opening 123.

As will also be seen from FIG. 7, the switch knob 117 carries two diametrically opposed outwardly extending arms 42, 43 with integral cheeks 44, 45 extending parallel to each other and at right angles to said arms, the arms and cheeks having offset portions 47, 48 to form grooves 49, 50. An insert 46 is retained on the switch knob by said arms and wings and is formed with lateral lugs 51, 52 which engage in the grooves 49, 50 to secure the offset to the switch knob. The top of the insert is covered by a segmental transparent plate 53 (FIG. 5) carrying a mask 54, preferably black, of appropriate pattern to form transparent insignia through which light which passes through the openings 123, 124 can be transmitted. FIG. 6 shows by way of example the mask 54 bearing an "I", to indicate a first position of the switch. If the switch is capable of more than one position, additional insignia can be applied to the plate 53 as required. The "OFF" position of the switch maybe indicated by a white colouration on the plate 53.

In order that only one of the insignia on the transparent plate 53 shall be visible at a time, the outer cylindrical wall 56 has integral therewith a deeply recessed internally extending flange 58 (FIGS. 5 and 6) provided with a segmental opening or recess 61 therein shaped so that if, for example, there are three insignia or symbols on the plate 53, only one of the symbols will be visible at each of the positions of adjustment of the rotary knob 117, as indicated in FIG. 6 in which the first position of the switch is shown, with the symbol "I" (55) visible in the recess 61.

The rotary switch knob 117 is formed with a radial boss 68 located diametrically opposite the opening 124 of the switch knob 117; and a spring 62 housed in a bore 67 in said boss presses a ball 63 radially outwards so that, on rotation of said knob 117 the ball 63 will engage in one of three depressions 64, 65 or 66 in the outer wall 56 to retain the knob in a desired angular position of adjustment, in which a symbol indicating the "OFF" or first or second condition of the switch is illuminated in the opening 61 in the flange 58.

As shown in FIG. 7, two stop faces 69, 70 are moulded integral with the outer wall 56, and project radially inwardly therefrom, so as to limit the angular movement of the switch knob 117 in either direction of rotation, the faces 69, 70 being engageable by corresponding faces 71, 72 on opposite sides of the boss 68.

The switch knob 117 is axially located by the engagement of the lower face of the inner peripheral portion of the flange 58 with an annular shoulder 59 formed on the switch knob 117; and near its lower end the knob is formed with a radial flange 117' which provides support for the insert 46 and adds rigidity to the switch knob structure.

In the use of either of the embodiments of the rotary switch according to the invention described herein, the location of the switch, (and, if desired, its function also) is revealed to a viewer whenever the light bulb of the switch is energised; and in addition, depending upon the position of rotation of the switch knob, the "ON" or "OFF" conditions of the switch are revealed to a viewer by the action of the switch knob in masking or unmasking the opening or openings by which light from the bulb can be projected laterally of the cylindrical inner wall of the stationary carrier, so that the light is either cut off from, or illuminates, a region between said switch knob and said outer wall in which, if desired, symbols or other indicia can be arranged for illumination by such light.

We claim:

1. A rotary switch provided with a light source for indicating the location of the switch when installed, and its condition, said rotary switch comprising a stationary carrier member including a base plate having concentric outer and inner cylindrical walls integrally formed therewith and extending therefrom so as to provide a space therebetween, a manually operable switch knob having a hollow cylinder portion mounted for rotation about said inner cylindrical wall between an "OFF" position and an "ON" position, a radially extending flange formed with said cylinder portion and extending between said inner and outer cylindrical walls so as to fill said space therebetween, a tubular housing integrally formed with said flange, detent means located within said tubular housing and cooperating with a recess formed in said base plate for maintaining said switch knob in said "OFF" and "ON" positions, a light bulb supported by said base plate and located within said inner cylindrical wall and said cylinder portion of said switch knob, said switch knob having a first opening formed therein to permit light rays emitted by said light bulb to be projected through said opening longitudinally of said cylinder portion so as to indicate the location of the rotary switch, and said inner cylindrical wall and said switch knob having apertured portions adapted to receive light projected laterally of said inner cylindrical wall from said bulb and arranged so that rotation of said switch knob brings the apertured portion of the switch knob into and out of radial alignment with the apertured portion of said inner cylindrical wall and effects a simultaneous change in the visible aspect of an indicator region of the switch, between said outer cylindrical wall and said cylindrical portion of the switch knob, which is illuminable by said light projected laterally from said bulb, and thereby indicates to a viewer that the switch is in an "ON" or "OFF" condition.

2. A rotary switch provided with a light source for indicating the location of the switch when installed, and its condition, said rotary switch comprising a stationary carrier member including a base plate having concentric outer and inner cylindrical walls rigidly formed therewith and extending therefrom so as to provide a space therebetween, a manually operable switch knob having a hollow cylinder portion mounted for rotation about said inner cylindrical wall between an "OFF" position and an "ON" position, a radially extending flange formed with said cylinder portion and extending between said inner and outer cylindrical walls so as to fill said space therebetween, a tubular housing formed with said flange, detent means located within said tubular housing and cooperating with at least two recesses formed in said base plate for maintaining said switch knob in said "OFF" and "ON" positions, a light bulb supported by said carrier member and located within said inner cylindrical wall and said cylinder portion of said switch knob, said switch knob having a first opening formed therein to permit light rays emitted by said light bulb to be projected through said opening longitudinally of said cylinder portion so as to indicate the location of the rotary switch, said switch knob cylinder portion being formed with a circular series of slots circumferentially equispaced therearound and said inner cylindrical wall being formed with a corresponding series of slots therearound, said inner cylindrical wall slots being adapted to receive light projected laterally of said inner cylindrical wall from said bulb and being arranged so that rotation of said switch knob brings said slots in the switch knob into and out of register with the slots in said inner cylindrical wall and thereby permits or blocks the passage of said laterally projected light so as to effect a simultaneous change in the visible aspect of an indicator region of the switch, between said outer cylindrical wall and said cylindrical portion of the switch knob, which is illuminable by said light projected laterally from said bulb, and thereby indicates to a viewer that the switch is in an "ON" or "OFF" condition.

3. A rotary switch provided with a light source for indicating the location and the particular condition of the switch when installed, said rotary switch comprising a stationary carrier member including a base plate rigidly formed with concentric outer and inner cylindrical walls so as to provide a cylindrical space therebetween, a manually operable switch knob having a cylinder portion mounted on said inner cylindrical wall for rotation between an "OFF" position and an "ON" position, a radially extending flange formed with said cylinder portion and extending between said inner and outer cylindrical walls so as to fill said space therebetween, a tubular housing integrally formed with said flange, detent means located within said housing and cooperating with a plurality of recesses formed in the base plate of said carrier member for maintaining said switch knob in said "OFF" and "ON" positions, a light bulb supported by the base plate of said carrier and located within said inner cylindrical wall, a first opening formed in said switch knob to permit light rays emitted by said light bulb to be projected through said opening longitudinally of said cylinder portion so as to indicate the location of the rotary switch, a plurality of openings formed in said switch knob to permit light rays from said light bulb to be projected through said openings substantially at right angles to the longitudinal axis of said cylinder portion, and a corresponding plurality of apertures formed in said inner cylindrical wall and adapted to register with said opening in said switch knob when said switch knob is in said "ON" position so as to cause light rays emitted from said light bulb to illuminate an indicator region bounded by said outer cylindrical wall and the cylinder portion of the switch knob and thereby indicate to a viewer that the switch knob is in said "ON" position, or to be brought out of register with said switch knob openings and prevent the illumination of said indicator region and thereby indicate that the switch knob is in said "OFF" position.

* * * * *